US005195907A

United States Patent [19]

Urban

[11] Patent Number: 5,195,907

[45] Date of Patent: Mar. 23, 1993

[54] TOOLESS ELECTRICAL CONNECTOR AND CONDUCTOR CABLE FOR USE THEREWITH

[76] Inventor: Joseph Urban, 3 Ocean Ave., Niantic, Conn. 06357

[21] Appl. No.: 531,118

[22] Filed: May 31, 1990

[51] Int. Cl.[5] ..... H01R 4/24

[52] U.S. Cl. ..... 439/410; 439/406

[58] Field of Search ..... 439/492–499, 439/67, 77, 395–407, 421–424, 372, 409, 410, 411, 406; 174/117 F, 117 FF

[56] References Cited

U.S. PATENT DOCUMENTS

| | | | |
|---|---|---|---|
| 1,977,677 | 10/1934 | Hill | 439/410 |
| 3,723,948 | 3/1973 | Wyatt et al. . | |
| 3,976,351 | 8/1976 | Hopfe . | |
| 4,130,934 | 12/1978 | Osick et al. | 174/117 F |
| 4,413,872 | 11/1983 | Rudy et al. . | |
| 4,426,125 | 1/1984 | Crawford . | |
| 4,492,815 | 1/1985 | Maros | 174/117 F |
| 4,560,225 | 12/1985 | Margaroli et al. | 439/422 |
| 4,638,117 | 1/1987 | Ney | 174/117 F |
| 4,793,823 | 12/1988 | Cozzens et al. . | |
| 4,933,513 | 6/1990 | Lee | 174/117 F |
| 4,938,713 | 7/1990 | Daly et al. | 439/422 |

FOREIGN PATENT DOCUMENTS

| | | | |
|---|---|---|---|
| 1064473 | 10/1952 | France | 174/117 F |
| 212810 | 9/1986 | Japan | 174/117 F |
| 2027553 | 2/1980 | United Kingdom | 174/117 F |

OTHER PUBLICATIONS

Industrial Design, Sep./Oct. 1988.
Appliance Engineering/Design, Nov. 1988.
Component Electrical System, Jun. 20, 1988.
Plastics Engineering, Oct. 1988.
ESD Technology, Nov. 1988.
Plastics Design Forum, Sep.–Oct. 1988.
Design News, Aug. 22, 1988.
Berkshire Eagle, Jul. 21, 1988.

*Primary Examiner*—David L. Pirlot
*Attorney, Agent, or Firm*—Morgan & Finnegan

[57] ABSTRACT

An improved tool-less electrical connector which can splice live wires from an insulated cable of any length has a base structure with a passageway for aligning the conductor cable. A clamping arm pivotally attached to the base structure has at least one clamping finger are holding the cable in the passageway. A splicing arm with pivotable cutting means splices a significant length of wire away from the insulation and a wire pusher ensures spatial and electrical connection of the spliced wire with a receptacle. The electrical connector can splice an asymmetrical conductor cable which is also provided.

27 Claims, 12 Drawing Sheets

TOOLESS ELECTRICAL CONNECTOR AND CONDUCTOR CABLE FOR USE THEREWITH

BACKGROUND AND OBJECTS OF THE INVENTION

The present invention relates generally to electrical connector devices, and, more particularly, to a new electrical connector adapted to securely splice and electrically connect a conductor cable to a downstream electrical connector without having to pre-cut the cable, and substantially without risk of generating excessive amounts of heat and resistance at the connection point between the exposed conductor wires and device connection elements.

While many types of electrical connectors are known in the art, there does not appear to be any that can provide a safe, reliable and solid connection between the wires of a conductor cable and the connection elements of the device without the generation of significant amounts of resistance and heat. Part of the reason for this is the type of cutting or splicing element utilized by these connectors, which typically do not splice and expose a large enough segment of each conductor wire embedded in the cable insulation, and which do not provide an adequate means for electrically connecting the exposed wires. Overall, these devices seem to require excess manipulation of the exposed wires in order to effect a stable electrical connection.

For example, Wyatt et al., U.S. Pat. No. 3,723,948, and Hopfe U.S. Pat. No. 3,926,351 disclose electrical connectors capable of being attached to insulated wires. However, these devices do not appear to provide a large enough surface area of connection between the spliced wire and the connection element to avoid the aforementioned problems. A preloaded electrical connector is also described in Rudy et al., U.S. Pat. No. 4,413,872. With this device the conductor cable must be exposed or "pre-cut" prior to installation in the connector. Cozzens et al., U.S. Pat. No. 4,793,823 discloses a cam lever connector which also requires that the conductor cable be "pre-cut". A hinged electrical connector which uses finger pressure to close the hinged parts of the connector over the cable is described in Crawford, U.S. Pat. No. 4,426,125.

Accordingly, it is an object of the present invention to provide a new electrical connector device which overcomes the foregoing disadvantages of the prior art.

It is also an object of the present invention to provide an improved electrical connector which can safely and reliably splice and connect conductor wires to a downstream electrical connector such as an electrical receptacle, switch, or the like. It is a further object of the invention to provide a new electrical connector which is durable, yet both compact and lightweight.

It is still another object of the present invention to provide a new electrical connector which can splice a sufficient length of a conductor cable to ensure secure connection between the cable wires and the device connection elements, and avoid the generation of excess resistance and heat at the connection points.

It is yet a further object of the present invention to provide a new electrical connector which can splice the conductor wires embedded in a conductor cable of any length, without having to first pre-cut the cable and expose the conductor wires.

It is a further object of the invention to provide a new electrical connector which can correctly splice and connect live wires to a downstream electrical connector.

It is yet another object of the invention to provide a new cable splicing mechanism which is readily adaptable for use with a wide range of known electrical connectors to achieve the foregoing advantages of the invention.

It is still another object of the present invention to provide a new electrical connector for use with "flat" or "ribbon" type conductor elements which achieves the foregoing advantages of the invention.

It is still a further object of the present invention to provide an efficient, safe, reliable and virtually foolproof electrical connection system utilizing the electrical connector of the invention and a new conductor cable specially adapted for use therewith.

The foregoing specific objects and advantages of the invention are illustrative of those which can be achieved by the present invention and are not intended to be limiting or exhaustive of the possible advantages which can be realized. Thus, these and other objects and advantages of the invention will be apparent from the description herein or can be learned from practicing the invention, both as embodied herein or as modified in view of any variations which may be apparent to those skilled in the art.

SUMMARY OF THE INVENTION

Briefly described, the present invention relates to an electrical connector device adapted to safely and securely splice and electrically connect a conductor cable to a downstream electrical connector without having to pre-cut or splice the cable, and substantially without risk of generating excessive heat or resistance at the connection points between the exposed conductor wires and the device connection elements.

As preferably embodied, the electrical connector of the invention generally comprises (1) a base structure, (2) a clamping arm pivotally engageable with the base structure, and (3) a splicing arm pivotally engageable with the clamping arm, all preferably formed from an injection-molded thermoplastic material. Because of the three part construction of the electrical connector device, a conductor cable of any length may be placed within the base structure prior to assembly, thereby eliminating the need to pre-cut the cable and expose the cable wires.

According to one specific aspect of the invention, the base structure is formed with a plurality of sockets, each providing upstanding sidewalls formed with bevelled edges, and each containing a generally U-shaped connection plate. The sidewalls of each connection plate are substantially jagged or rough-textured on their inner facing surfaces. As here embodied, one sidewall of each connection plate is integrated with a connection element providing a notch therewithin adapted such that the connection plate can be snappingly engaged with a prong member extending downwardly from the base structure into the corresponding socket. Each connection element is further formed with a generally L-shaped slot stamped thereinto which is adapted to receive the plug blades of an interior plug member provided in accordance with one embodiment of the invention as a vehicle for electrically connecting the device to a downstream electrical connector.

As preferably embodied, the base structure is formed with a raised pier extending across substantially the entire length thereof. The pier acts as an alignment post against which the non-conductive portion or ribbon cable portion of a conductor cable to be spliced can rest during the splicing process. As here embodied, the pier is formed with a grooved depression providing a plurality of receiving sockets, each proportioned to fixedly engage a standard insulation displacement connector (IDC). The IDC's are adapted to pierce and connect the ribbon conductors of a ribbon cable which is provided as part of the overall conductor cable.

According to another aspect of the invention, an interior plug member is provided as one alternative for electrically connecting the electrical connector of the invention to a downstream electrical connector. As here embodied, the interior plug comprises a plug body providing a plurality of plug blades, a plurality of pin connector elements, and electrically integrated with an electrical cable. The plug blades are arranged on the plug body such that each can be slidably inserted through an opening formed in the bottom of the corresponding connection plate socket, and thereby electrically mated with the corresponding connection element via the receiving slot formed therein. The pin connector elements are arranged on the plug body so that they may be slidably inserted into the corresponding receiving sockets formed in the grooved depression of the pier member, and thereby electrically mated with the corresponding IDC's. The plug member further includes connecting elements enabling it to be slidably frictionally attached to the underside of the base structure via a receiving channel formed therewithin.

According to another specific aspect of the invention, the electrical connector is provided with a clamping arm formed with opposed circular fitting extensions adapted to mate with a pair of opposed mounting grooves formed in the base structure such that the clamping arm can pivotally rotate about 180 degrees from the base structure. The clamping arm is formed with a clamping finger adapted to urge a portion of the conductor cable into a cable trench formed in the base structure and hold it therewithin. Thus, the conductor cable can be positioned and held within the base structure prior to splicing without first having to pre-cut the cable and expose the cable wires. As preferably embodied, the clamping finger is formed with a plurality of clamping thumbs extending rearwardly thereof and positioned substantially perpendicular thereto. The clamping thumbs provide additional downward clamping pressure against the top of the conductor cable to maintain it in a fixed position, and during splicing help to hold the cable insulation down on the bevelled edges of the connection plate sockets to facilitate tearing of the insulation away from the conductor wires during the splicing process.

So that the clamping arm may be maintained in a closed-contact position with respect to the base structure and the conductor cable, the back of the clamping arm is formed with a pair of opposed inverse latching elements corresponding to a pair of latching elements formed on the base structure. As here embodied, downward pressure applied to the back of the clamping arm will cause the inverse latching elements formed thereon to contact and thereafter snappingly engage the latching elements formed on the base structure, thereby effectively preventing the clamping arm from rotating about the base structure.

According to another specific aspect of the invention, the splicing arm is formed with a pair of opposed mounting knobs preferably molded to opposite ends of an axle member disposed through the splicing blades. In similar fashion to the procedure for mounting the clamping arm to the base structure, the mounting knobs are adapted to mate with a second pair of mounting grooves formed in the forward end of the clamping arm such that the splicing arm can pivotally rotate about the clamping arm.

To facilitate splicing of the conductor cable in accordance with the practice of the present invention, the splicing arm is preferably provided with three splicing blades, each splicing blade being formed integrally with a wire pusher element. As here embodied, each wire pusher element flares slightly outwardly from its corresponding splicing blade so as to form a gap therebetween, and each blade and wire pusher are formed with sharpened contact surfaces for cutting through the cable insulation. As the splicing arm rotates about the clamping arm and base structure, the sharpened edges of each splicing blade/wire pusher pair will cut through the cable insulation and grasp a conductor wire in the gap therebetween. Further rotation of the splicing arm will cause each splicing blade/wire pusher pair to push the corresponding conductor wire into the corresponding connection plate socket, and thence into the corresponding connection plate.

As preferably embodied, the width of each blade/-pusher pair is generally equal to the distance between the jagged inner surfaces of the corresponding connection plate sidewalls, thus causing the sidewalls to resiliently yield outwardly as the blade and wire pusher rotate through the connection plate. As the blade/-pusher pair exits the corresponding connection plate, the sidewalls will spring back causing the jagged inner surfaces thereof to frictionally engage the corresponding conductor wire, thereby holding the wire in electrical contact with the connection plate and allowing the blade and pusher to move free of the wire.

According to another specific aspect of the invention, a conductor cable is provided which is particularly well suited for use with the electrical connector described above. As here embodied, the conductor cable provides three insulated conductor wires embedded wherein two of the wires are asymmetrically separated from the third by a series of smaller conductor wires embedded within a flat or ribbon type cable. As preferably embodied, the insulation surrounding the three conductor wires is preferably square or rectangular in configuration, and is formed with a contact groove located above each conductor wire which provides an entry point for one of the splicing blades. The cable is further provided with relief grooves positioned on the underside of the insulation in substantial vertical alignment with, or slightly off the vertical line of the contact grooves. The relief grooves provide an exit point for the splicing blades as they cut through the cable.

According to another specific aspect of the invention, the base structure has an asymmetrical cross-section corresponding to that of the conductor wire such that the conductor cable can be positioned therein with each conductor wire disposed above a corresponding connection plate socket, and resting upon the bevelled edges of the socket sidewalls. As will be readily apparent to those skilled in the art, the asymmetrical cross-sections of the base structure and cable intrinsically reduce the potential for cable misalignment within the fully assembled connector. Thus, if the conductor cable were inadvertently rotated along its planar axis, it would not align properly in the base structure, thereby precluding subsequent installation of the clamping and splicing arms.

It will be appreciated by those skilled in the art that the foregoing brief description and the following detailed description are exemplary and explanatory of the invention, but are not intended to be restrictive thereof or limiting of the advantages which can be achieved by the invention. Thus, the accompanying drawings, referred to herein and constituting a part thereof, illustrate preferred embodiments of the invention, and, together with the detailed description, serve to explain the principles of the invention.

DETAILED DESCRIPTION OF THE PREFERRED EMBODIMENTS

Figures 1, 1A:
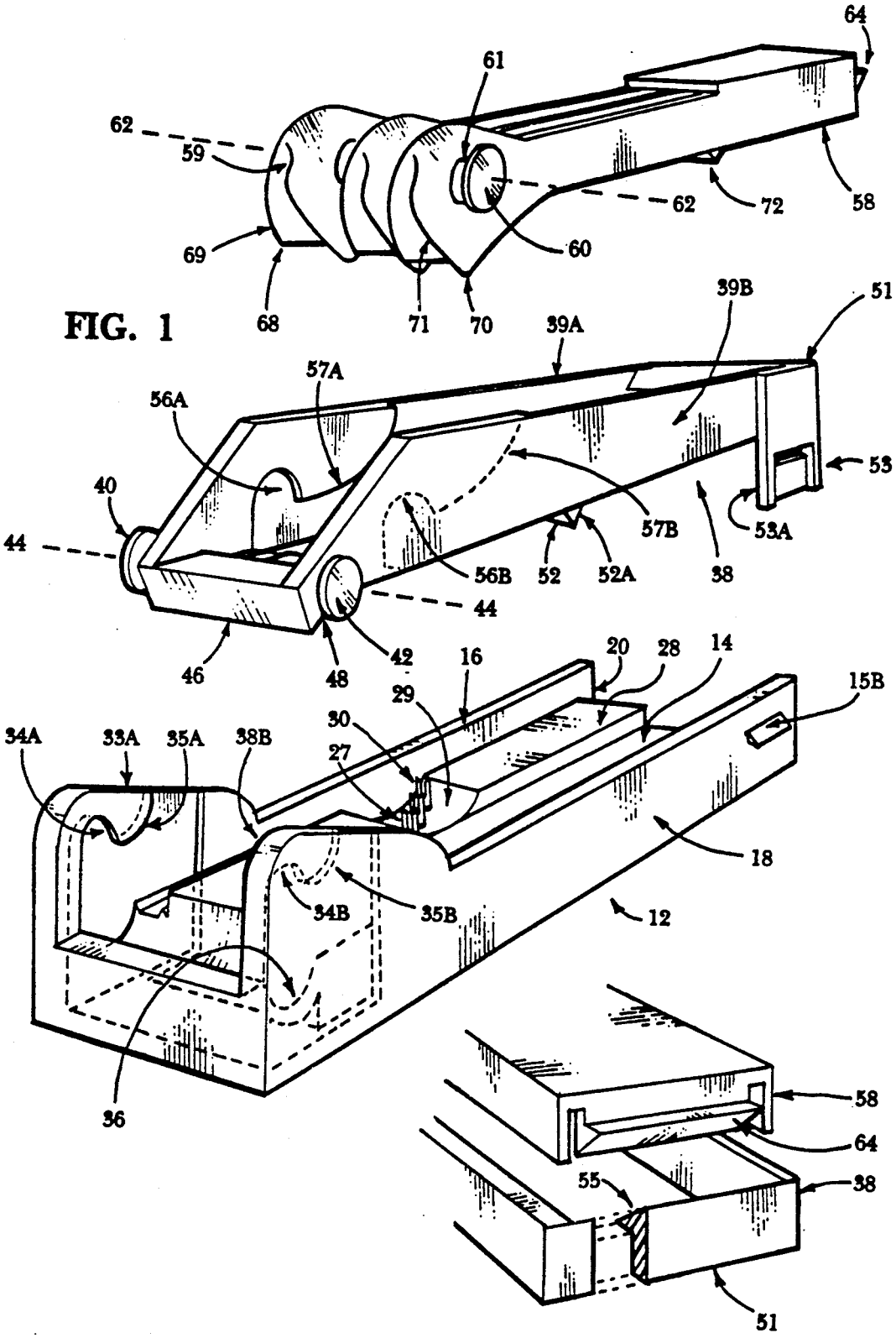
FIG. 1 is an exploded perspective view of an electrical connector according to one embodiment of the present invention.
FIG. 1A is a perspective view of one embodiment of the means for connecting the base structure and clamping arm of the electrical connector shown in FIG. 1.

Referring now to the accompanying drawings, wherein like reference numerals indicate like components throughout the various views, FIGS. 1–10 illustrate preferred embodiments of the tool-less electrical connector device (indicated generally by reference numeral 10) according to the present invention. As preferably embodied, the connector elements, hereinafter described, are fabricated from an injection-molded thermoplastic material, but may be manufactured from any rigid, durable material known in the art. Moreover, although the dimensions to which connector 10 may be fabricated to suit the particular needs of those skilled in the art are innumerable, it is preferred that connector 10 be both lightweight and compact, the entire device being preferably about 3½ inches to about 4 inches in length, and about 2 inches to about 3 inches in width.

Referring more particularly to FIG. 1, connector 10 generally comprises (1) a base structure 12, (2) a clamping arm 38 pivotally engageable with base 12, and (3) a splicing arm 58 pivotally engageable with clamping arm 38. As here embodied, base structure 12 is preferably provided with a bottom segment 14 formed integrally with opposed sidewall members 16 and 18. Preferably, sidewalls 16, 18 extend substantially the entire length of the bottom segment, and are each formed with a projecting "male" latching element (15A, 15B) having a generally triangular cross-section, which engages the corresponding "female" latching element (52, 53) formed on clamping arm 38 (as fully described below) to connect the base structure to the clamping arm. Bottom segment 14 and opposed sidewalls 16 and 18 together form a passageway 20 through the base structure 12 to receive an insulated conductor cable to be spliced and connected to a downstream electrical connector such as a receptacle, switch or the like.

As will be readily apparent to those skilled in the art, the three-part construction of device 10 allows a conductor cable of any length to be placed within the base structure prior to assembly, and eliminates the need to expose the cable wires by pre-cutting the cable prior to passing it through the connector. Thus, the electrical connector can splice and connect the conductor wires embedded in the conductor cable insulation without reference to a termination point on the cable. As will be apparent from the discussion below, because the elements of the connection plates are the only elements of electrical connector 10 which are in significant electrical contact with the downstream electrical receptacle, switch, etc., the electrical connector of the invention can also safely and correctly splice and connect live conductor wires.

Figure 3:
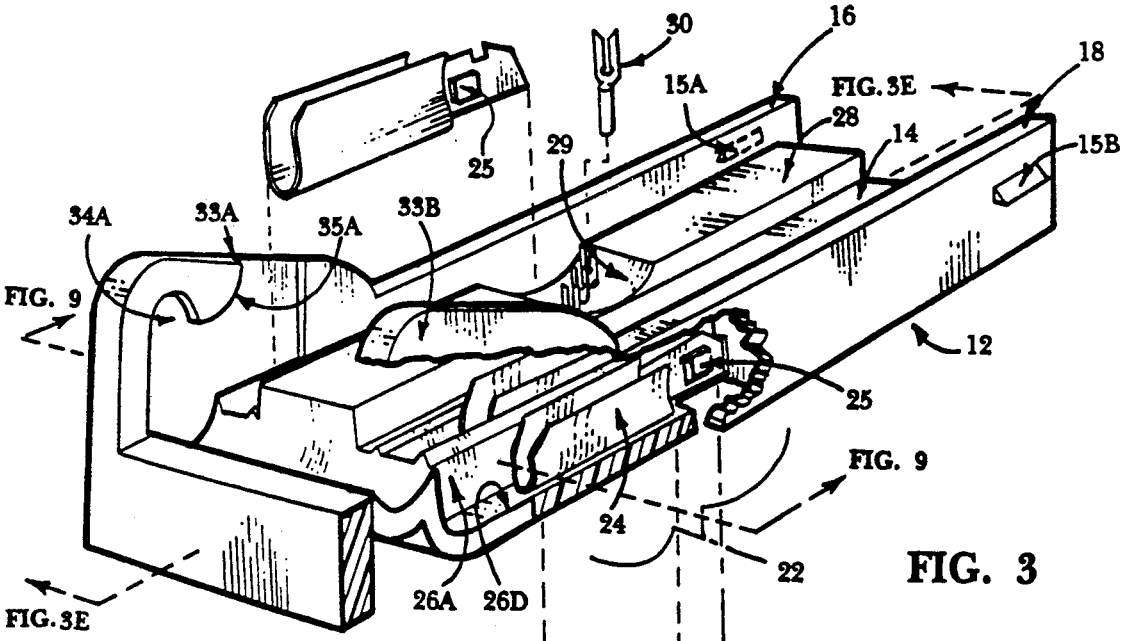
FIG. 3 is a partially cut-away perspective view of the base structure for the electrical connector shown in FIG. 1.
Figure 3A:
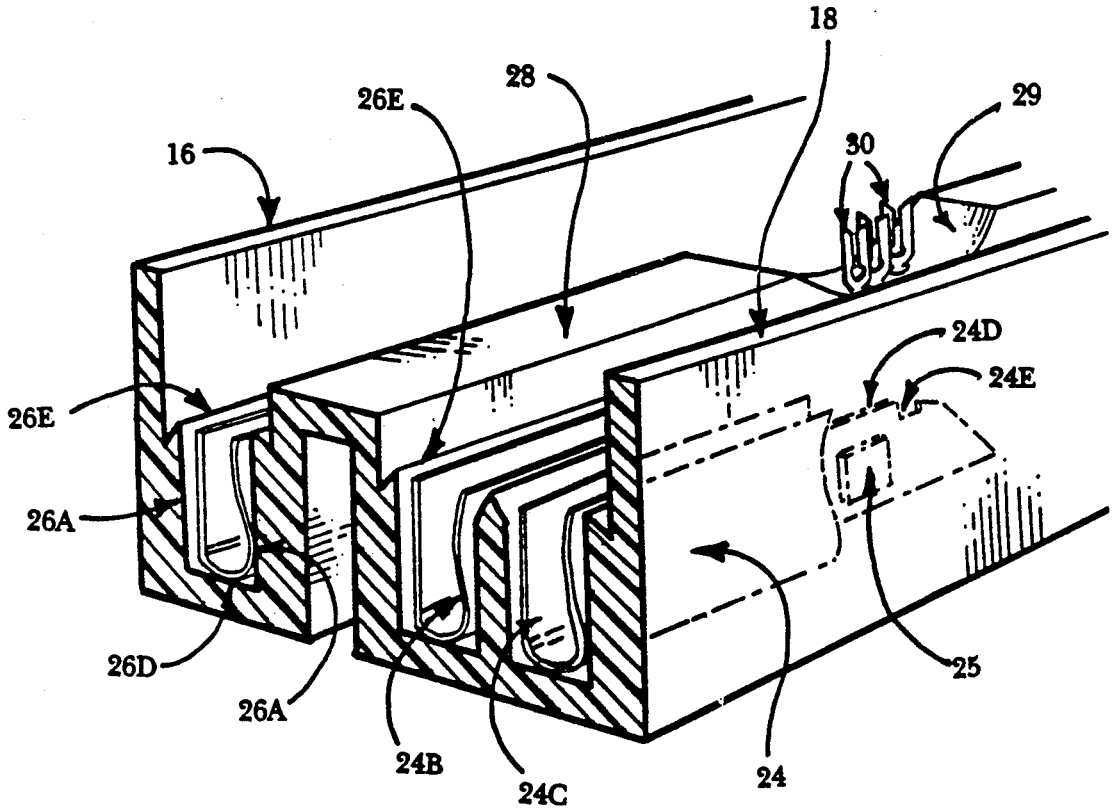
FIG. 3A is a front elevation view in perspective through line A—A of the base structure shown in FIG. 3.

Referring to FIGS. 1 and 3, base structure 12 is preferably provided with a connection plate housing portion 22 formed in the forward part of bottom segment 14 between extending tabs 33A and 33B (described below) of sidewalls 16 and 18, respectively. As shown in FIG. 3A, housing 22 is formed with a plurality of sockets 26. Each socket is defined by a pair of sidewall members (illustrated by reference numeral **26*a*) and a bottom portion 26*d*, and is proportioned to receive a connection plate 24 and hold it within the housing. As here embodied, each socket is formed with an opening 26*c* in bottom portion 26*d* thereof proportioned to receive the plug blades of an interior plug 80 (described below) provided in accordance with one embodiment of the invention to electrically connect device 10 to the downstream electrical connector. As shown in FIG. 3A, each socket 26 is also formed with an inwardly bevelled edge 26e along each upstanding sidewall 26a thereof. As more fully described hereinafter, bevelled edges 26e** help to tear and hold the insulation surrounding the conductor table wires during the splicing operation.

Figure 3B:
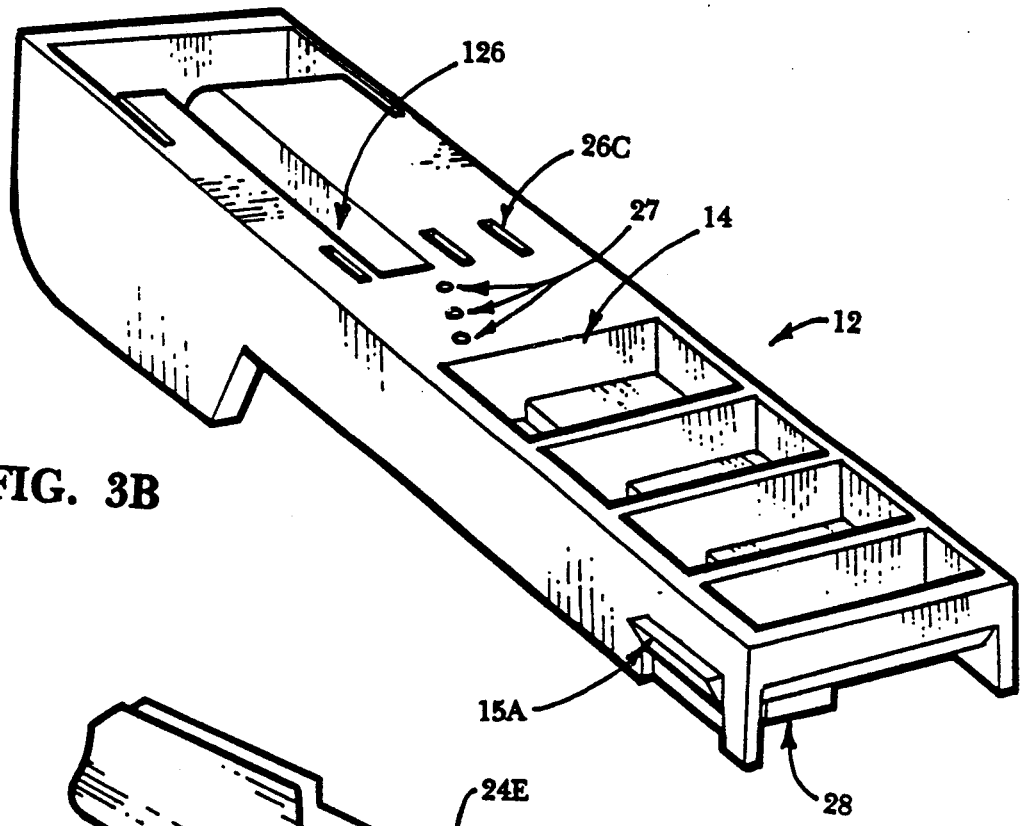
FIG. 3B is a bottom view in perspective of the base structure shown in FIG. 3.
Figure 3C:
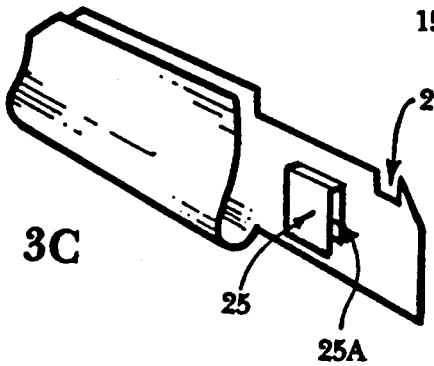
FIG. 3C is a perspective view of one of the connection plates provided for the electrical connector shown in FIG. 1.
Figure 3D:
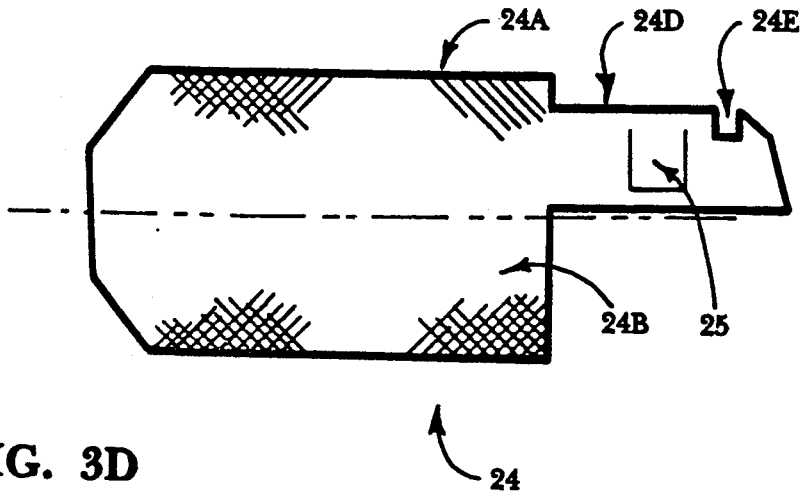
FIG. 3D is a side elevation view through line B—B of the connection plate shown in FIG. 3C.
Figure 3E:
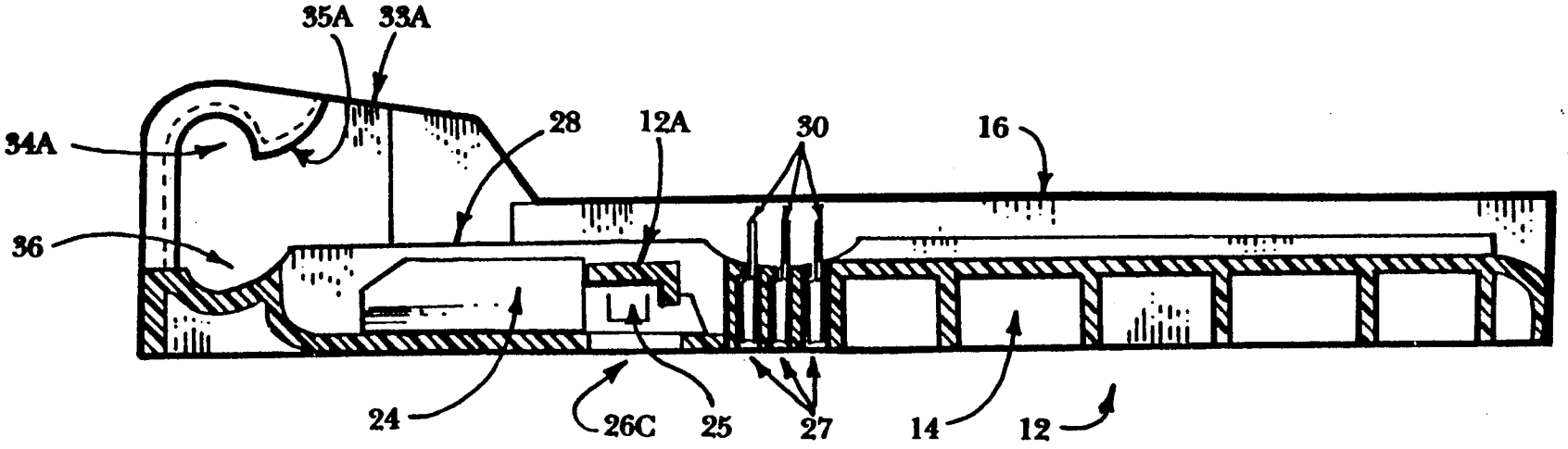
FIG. 3E is a side elevation view through line C—C of the base structure shown in FIG. 3.

Referring also to FIGS. 3C and 3D, as here embodied each connection plate 24 is formed with an open, generally U-shaped wire receiving and engaging element 24a providing sidewall members 24b, 24c which are substantially jagged or rough-textured on their inner facing surfaces. Each element 24a is formed integrally with a connection element 24d extending laterally from sidewall 24c thereof. Each connection element 24d is provided with a connection prong member 25 stamped thereinto which, as more fully described below, forms a generally L-shaped slot 25a adapted to receive the plug blades of interior plug 80. Each connector plate 24 is slidably inserted within the corresponding socket 26 so as to extend laterally along the bottom portion 26d thereof. As here embodied, each connection element 24d is formed with a notch 24e to receive a prong member 12a which extends downwardly from the underside of bottom segment 14 into each socket 26 (see FIG. 3E). As each connection plate 24 is slidably inserted into its corresponding socket 26, the corresponding prong 12a will snap into notch 24e to securely retain the connection plate within the socket.

As preferably embodied, each connection plate 24 is fabricated from a conductive sheet metal material, but may be fabricated from any other conductive material. Also, it is preferred that three connection plates 24 be provided, with the number of sockets 26 equalling the number of connection plates. However, it is also within the scope of the invention to provide more sockets than connection plates to accommodate applications where it is not desired to splice and connect all of the conductor wires present within a cable.

Moreover, while it is preferred that the arrangement of connection plates 24 and sockets 26 in the base structure 12 be as shown in FIGS. 3 and 3A, alternative arrangements to accommodate the number and arrangement of conductor wires of the particular cable used with connector 10 are certainly possible. For example, it is possible to design a more symmetrical arrangement of the socket holes 26, with three evenly spaced holes. This arrangement would match a conductor cable with three evenly spaced conductor wires buried in its insulation. It is also foreseeable to design, for example, a four socket arrangement that could be utilized in conjunction with a two, three or four wire conductor cable.

Referring again to FIGS. 3 and 3A, base structure is further formed with a raised pier 28 extending across substantially the entire length of bottom segment 14. Pier 28 acts as an alignment post against which the non-conductive portion, for example the plastic strip, of a conductor cable to be spliced rests. If the conductor cable to be spliced instead contains a substantially flat ribbon cable strip in lieu of a non-conductive strip, then this ribbon strip would be aligned over the top of pier 28. As shown in FIG. 3 and 3A, pier 28 is preferably positioned relative to bottom segment 14 so as not to block either the openings of sockets 26 or the connection plate(s) 24. As here embodied, pier 28 is preferably dimensioned to rise to a height not exceeding, and most preferably below, the height of side walls 16, 18 of the base structure.

According to the invention, pier 28 is formed with a grooved depression 29 preferably positioned approximately at the mid-point of the pier. The low point of the groove substantially coincides with the top surface of bottom segment 14. Within grooved depression 29 are formed a plurality of receiving sockets 27 (see FIG. 3B). As here embodied, each receiving socket 27 is proportioned to fixedly engage a standard insulation displacement connector 30 (hereinafter IDC's) Each IDC 30 is a piercing and connecting element which can cut the parallel ribbon conductors embedded in a "ribbon" or "flat" type conductor cable of the type, for example, described in U.S. Patent No. 4,426,125 (see also FIG. 8 herein). While it is preferred that the ribbon cable receiving sockets and IDC's be arranged in diagonal fashion as shown in FIGS. 1 and 3B, any other alternative arrangement suitable to facilitate the ribbon cable splicing function of connection 10 is certainly within the scope of the invention.

Figure 2:
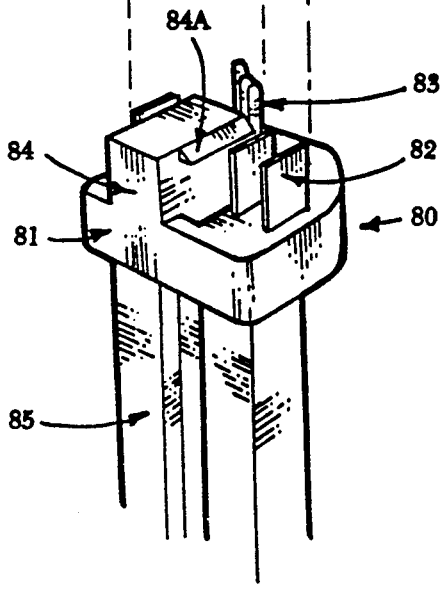
FIG. 2 is a perspective view of an adaptor for electrically connecting the electrical connector shown in FIG. 1 with a downstream electrical connector in accordance with one preferred embodiment of the present invention.

Referring now to FIG. 2, there is shown an interior plug 80 provided as one alternative vehicle for electrically connecting device 10 to the downstream electrical connector. As here embodied, interior plug 80 comprises a plug body 81 providing a plurality of plug blades 82, a plurality of pin connector elements 83, and is electrically integrated with an electrical cable 85. According to the invention, blades 82 are arranged on plug body 81 such that each can electrically mate with the corresponding prong connection member 25 formed on each of the connection plates 24. So too, pin connector elements 83 are arranged on plug body 81 in accordance with the arrangement of receiving sockets 27 formed in grooved depression 29 of pier 28 (as here embodied, pin connectors provide less than 2 amps of electrical current, and thus, do not pose a safety consideration). As preferably embodied, interior plug 80 further includes an upstanding connecting element 84 formed with a tab member 84a. Element 84 can be slidably frictionally inserted into a channel 12b formed within base structure 12 beneath pier 28 (see FIG. 3B). Preferably, channel 12b includes an integral notch portion (not shown) proportioned to receive tab 84a of element 84.

To electrically connect interior plug 80 to connector 10, each plug blade 82 is slidably inserted through opening 26c formed in the corresponding bottom portion 26d of socket 26, and then slidably inserted within the corresponding slot 25a whereupon it will frictionally engage the corresponding connection prong member 25. At the same time, each pin connector 83 is slidably inserted through the corresponding receiving socket 27 so as to electrically mate with the corresponding IDC 30 (if the conductor cable to be spliced does not have ribbon cable elements, then neither the receiving sockets 27/IDC's 30 nor pin connectors 83 would be required). Interior plug 80 is then secured to base 12 by slidably frictionally inserting connecting element 84 into channel 12b.

It should be noted that the foregoing manner for providing electrical connection between device 10 and the downstream electrical connector represents one alternative embodiment for achieving this result, and is not intended to be limiting of the invention. For example, each connection plate 24 may alternatively be provided with a typical screw connection formed on connection element 24d so that device 10 can be directly connected to the electrical wires of the downstream connector, without the need for having an intermediate adaptor 80. Additionally, each element 24 could be formed with a plug blade depending downwardly through the corresponding opening 26c of socket 26 for direct electrical connection to a downstream receptacle or switch adapted to receive such connection elements. Moreover, device 10 could also be adapted such that the electrical cable connecting device 10 to the downstream electrical connector is electrically connected directly to the connection plates.

Referring to FIG. 1, sidewalls 16, 18 of base structure 12 are each further formed with an upwardly projecting tab (33A, 33B) at the forward end of bottom segment 14. As here embodied, the inner facing surfaces of tabs 33A and 33B are each formed with a fitting groove (34A and 34B) generally in the shape of a downwardly curved arc, and an arcuately shaped mounting ridge (35A, 35B) positioned adjacent the corresponding fitting groove. As more fully described hereinafter, fitting grooves 34A, 34B and mounting ridges 35A, 35B are utilized to pivotally attach clamping arm 38 to the base structure 12. Referring to FIGS. 1 and 3, a raised cable trench 36 is formed at the forward end of bottom segment 14 of the base structure. As here embodied, cable trench 36 provides a seat within which a portion of the conductor cable will be clamped and held against movement during the splicing operation (described in full detail below). As further shown in FIG. 3, it is preferable that the forward part of pier 28 extend up to and terminate at cable trench 36.

Referring again to FIGS. 1, 4 and 4A–4C, there is shown clamping arm 38 according to the present invention. As here embodied, clamping arm 38 provides a pair of opposed sidewalls 39A and 39B which are connected via a clamping finger 46 (hereinafter described) to form an opening 39C for receipt of splicing arm 58. According to the invention, once a cable to be spliced is positioned in the passageway 20 of base structure 12, the clamping arm 38 can be releasably pivotally mounted to the base structure. To this end, clamping arm 38 is formed with a pair of opposed fitting extensions 40, 42 on the forward external surfaces of sidewalls 39A, 39B, respectively. To connect the clamping arm to base structure 12, the clamping arm is first turned upside down with clamping finger 46 positioned toward the back end of the base structure. The clamping arm is then advanced forwardly in contact with the conductor cable such that fitting extensions 40 and 42 slide downwardly along their corresponding arcuate mounting ridges (35A, 35B).

The downwardly curved arc of mounting ridges 35A, 35B will cause the clamping arm to bear down on the cable, in turn causing the cable to exert an opposing resilient force on the clamping arm. When fitting extensions 40, 42 reach the openings to the corresponding fitting grooves (34A, 34B), further arcuate movement of the fitting extensions along their respective mounting ridges combined with the resilient force of the cable will cause the fitting extensions to pop up into the mounting grooves. The resilient force of the conductor cable against the clamping arm provides a spring action which keeps the fitting extensions securely positioned within their fitting grooves.

As here embodied, fitting grooves 34A, 34B are shaped to correspond to the shapes of fitting extensions 40, 42 so as to allow free pivotal movement of the clamping arm within and relative to the base structure. As shown in FIG. 1, the pivotal movement of clamping arm 38 within base 12 is defined by pivot axis 44 extending through the approximate center of fitting extensions 40, 42. Preferably, the fitting extensions are substantially circular in configuration, but may be fabricated in any other shape consistent with the object of providing maximum rotational clamping action.

Figure 4:
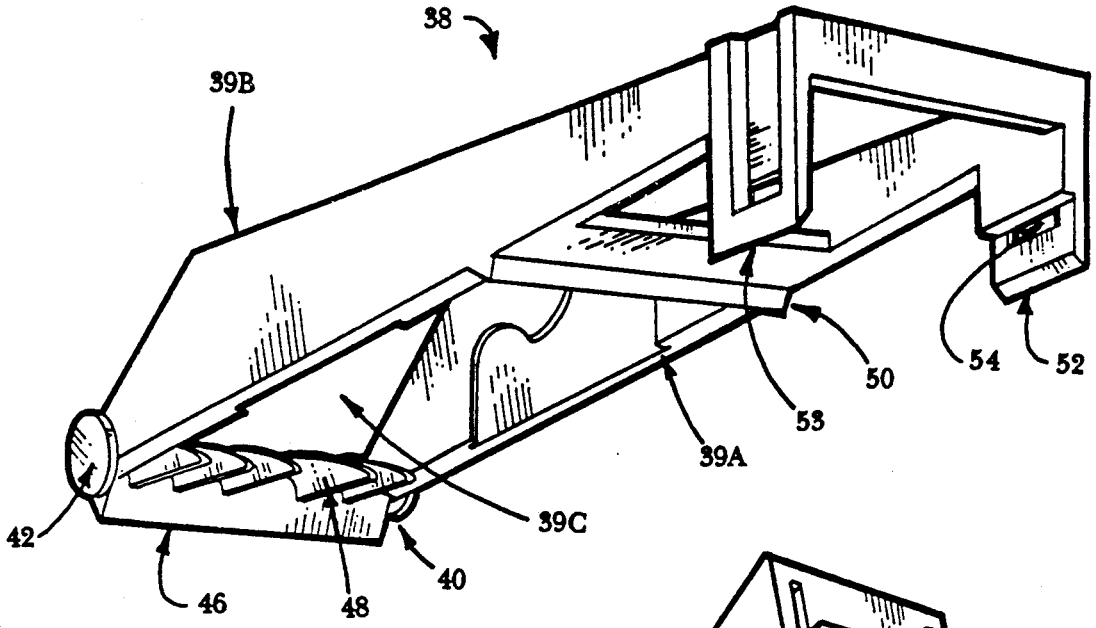
FIG. 4 is a bottom view in perspective of one preferred embodiment of the clamping arm for the electrical connector shown in FIG. 1.
Figure 4A:
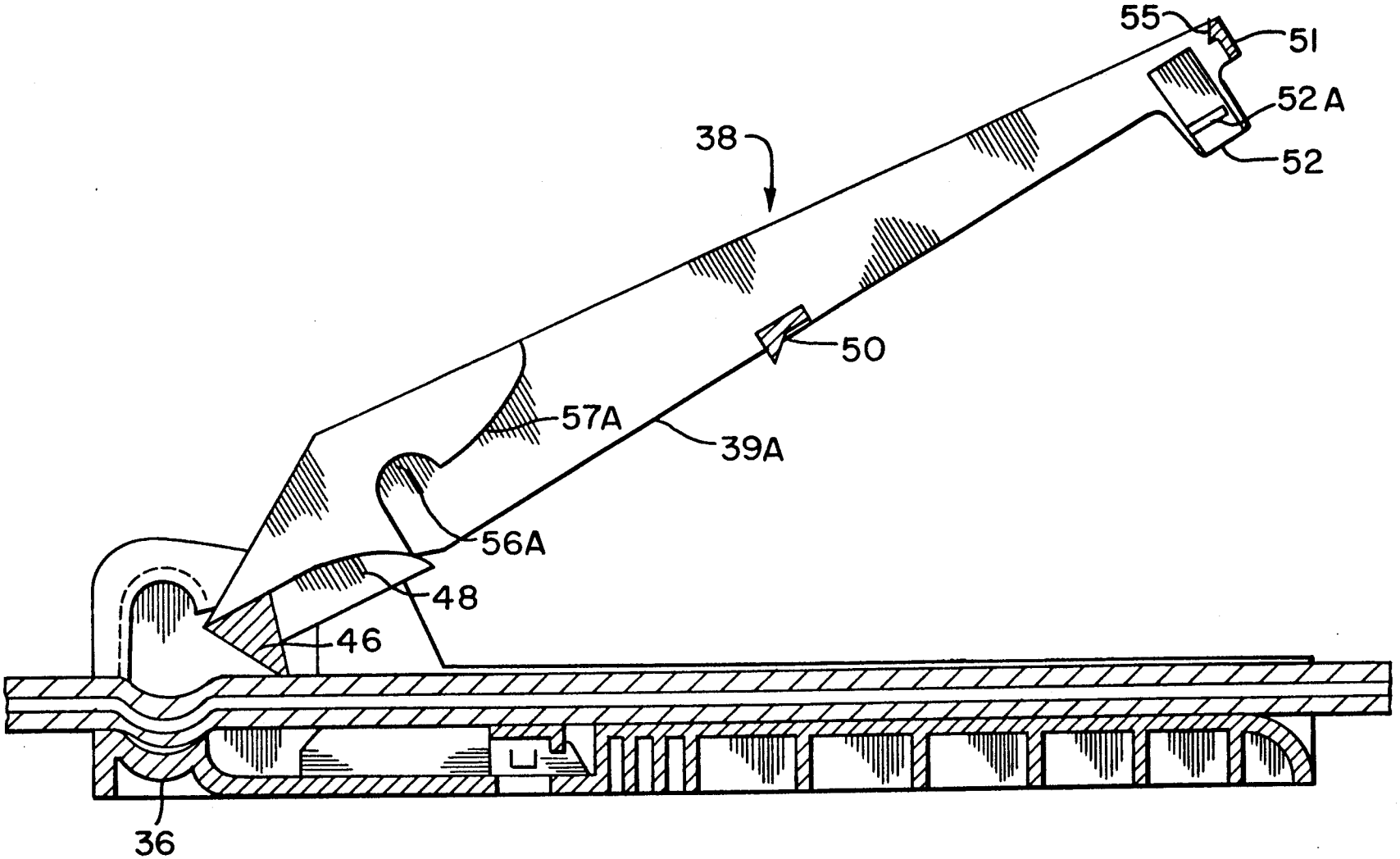
Figure 4B:
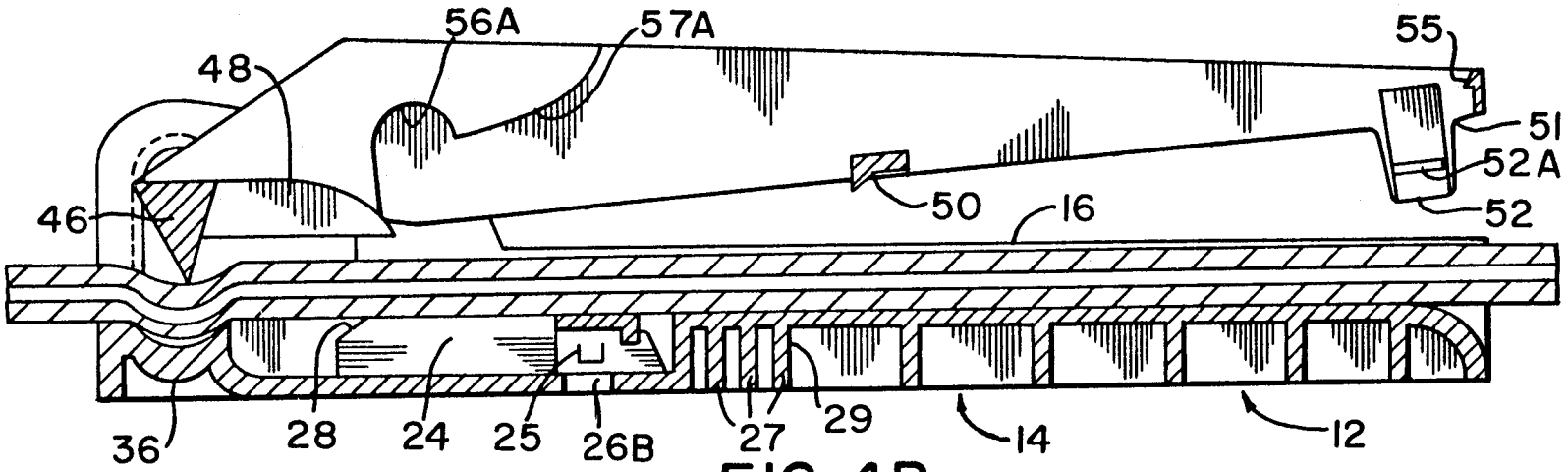
Figure 4C:
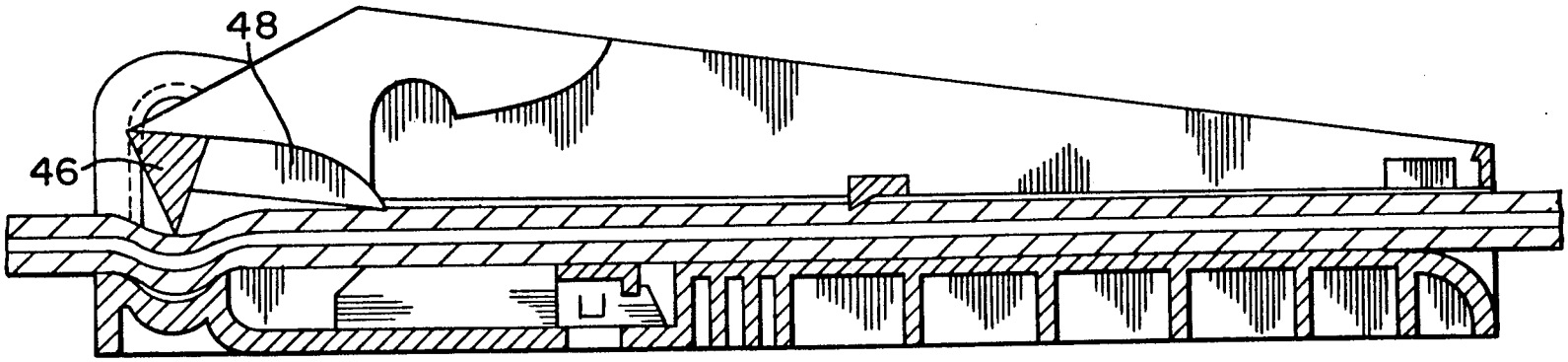

As shown in FIGS. 1 and 4, a clamping finger 46 is formed integrally with opposed sidewalls 39A and 39B, and is bounded by fitting extensions 40 and 42. As here embodied, clamping finger 46 is substantially triangular in cross-section and positioned at the most forward part of the clamping arm, extending downwardly with respect to pivot axis 44. In operation, once fitting extensions 40 and 42 are positioned within their respective mounting grooves, clamping arm 38 is rotated clockwise (using the orientation of the clamping arm shown in FIGS. 4A–4C as a frame of reference) causing clamping finger 46 to urge a portion of the conductor cable into cable trench 36 and hold it in place therewithin. In this position, the cable will be slightly deformed due to the pressure of clamping finger 46 against it. Thus, the conductor cable can be positioned and held within the base structure prior to splicing without first having to "pre-cut" the cable and expose the cable wires. Although it is preferred that there be one clamping finger extending substantially the entire length of the cable trench 36, as shown in FIG. 4, clamping finger 46 may be segmented into two or more additional clamping fingers positioned in substantial lateral alignment to one another.

Referring now to FIGS. 4 and 4A–4C, clamping finger 46 is preferably provided with a plurality of clamping thumbs 48 extending rearwardly thereof and positioned substantially in perpendicular with respect to pivot axis 44. As here embodied, clamping thumbs 48 provide additional downward clamping pressure against the top of the conductor cable to maintain it in a fixed position within the base structure, and, as described below, press the cable insulation down on bevelled edges 26c of sockets 26 to facilitate tearing of the insulation away from the conductor wires during the splicing process. Preferably, the total number of clamping thumbs should equal the total number of sockets 26. Thus, in a preferred embodiment of base structure 12 shown in FIG. 3A, there would be three clamping thumbs positioned along the length of clamping finger 46. Referring to FIG. 4, it is also within the scope of the invention to provide multiple clamping thumbs for each socket 26. It is also preferred that clamping thumbs 48 be positioned as close as possible to the plane of rotation of the corresponding splicing blades 68 (hereinafter described), without physically contacting the blades during rotation thereof, so as to increase the shear force provided by each blade during the splicing process.

According to another aspect of the invention, clamping arm 38 is provided with a third clamping element 50 located rearwardly of both clamping finger 46 and clamping thumb 48, and extending transversely between sidewalls 39A and 39B. Clamping element 50 also fits between sidewalls 16 and 18 of the base structure so as to connect the inner facing surfaces thereof. In this embodiment of the invention, clamping finger 46, thumbs 48, and element 50 operate together to prevent lateral or longitudinal movement of the cable within the base structure prior to splicing.

As preferably embodied, clamping arm 38 is further formed with a lever arm 51 at the back end thereof (see FIG. 1A) which can be operated to rotate the clamping arm about its pivot axis 44. Advantageously, clamping arm 38 will have a pivotal rotational range about axis 44 of up to about 180 degrees. In this regard, the portions of tabs 33A and 33B defining fitting grooves 34A and 34B, respectively, act to prevent the clamping arm from accidentally being pulled out of the base structure during pivotal movement thereof.

So that clamping arm 38 may be maintained in a closed-contact position with respect to base structure 12 and the conductor cable, lever arm 51 is preferably formed with an opposed pair of inverse latching elements 52 and 53 extending downwardly therefrom. As here embodied, inverse latching elements 52 and 53 are each formed with a slotted opening 52A, 53A, respectively, proportioned to receive latching elements 15A and 15B, respectively, formed on sidewalls 16, 18 of base structure 12. To place clamping arm 38 in a closed position with respect to base structure 12, inverse latching elements 52, 53 are moved downwardly Via lever arm 51 into contact with latching elements 15A, 15B. Further downward pressure applied to lever arm 51 will cause inverse latching elements 52, 53 to move downwardly relative to latching elements 15A, 15B and at the same time yield outwardly therefrom, thereby causing elements 15A, 15B to snap into slots 52A, 53A, respectively. In this position, clamping finger 46, clamping thumb 48, and clamping element 50 will be pressed against the conductor cable, and clamping arm 38 will be effectively prevented from further rotational movement about its pivot axis 44. Those skilled in the art will readily recognize that the latching elements described above provide merely one alternative for securing the clamping arm to the base structure so as to prevent movement of the clamping arm relative thereto, and that the present invention contemplates any other alternative for achieving the same purpose.

As shown in FIGS. 1A and 4A–4C, clamping arm 38 may further be formed with an additional latching element 55 having a substantially right-triangular cross-section, and extending substantially across the inside back end of lever arm 51. As discussed below, latching element 55 is engageable with a snap clamp 64 formed on splicing arm 58 to maintain the clamping and splicing arms in a closed-contact position. Finally, as shown in FIG. 1, the inner facing surfaces of sidewalls 39A and 39B are each formed with a mounting groove (56A, 56B) and an adjacent mounting ridge (57A, 57B). As described more fully below, mounting grooves 56A, 56B and mounting ridges 57A, 57B function in substantially the same manner as fitting grooves 34A, 34B and mounting ridges 35A, 35B described above to connect splicing arm 58 to clamping arm 38.

Referring once again to FIG. 1, electrical connector 10 of the present invention is further provided with a splicing arm 58. As here embodied, splicing arm 58 is formed with a pair of mounting knobs 59, 60 preferably molded to opposite ends of an axle member 61 disposed through splicing blades 68 (described below). Preferably, mounting knobs 59, 60 are substantially circular in shape, but may be of other configurations. In similar fashion to the procedure for mounting clamping arm 38 to base 12, discussed above, splicing arm 58 is mounted to clamping arm 38 by first inverting the splicing arm and orienting it such that the splicing blades face the back end of the clamping arm. The splicing arm is then advanced forwardly in contact with the conductor cable causing knobs 59, 60 slide along the corresponding arcuate ridges 57A, 57B. As with the clamping arm, the downwardly curved arc of ridges 57A, 57B will cause the splicing arm to bear down on the cable, in turn causing the cable to exert an opposing resilient force on the splicing arm.

When knobs 59, 60 reach the openings into mounting grooves 56A, 56B, further arcuate movement of the knobs along their respective mounting ridges combined with the resilient force of the conductor cable will cause the knobs to pop up into their respective mounting grooves. As with the clamping arm, the resilient force of the conductor cable against the splicing arm provides a spring action which keeps the knobs securely positioned within the fitting grooves. As more fully described below, because the splicing arm contacts the conductor cable as it is being advanced forwardly to connect it to the clamping arm, the splicing blades will pierce the cable and make initial guide cuts in the cable insulation.

Figure 5:
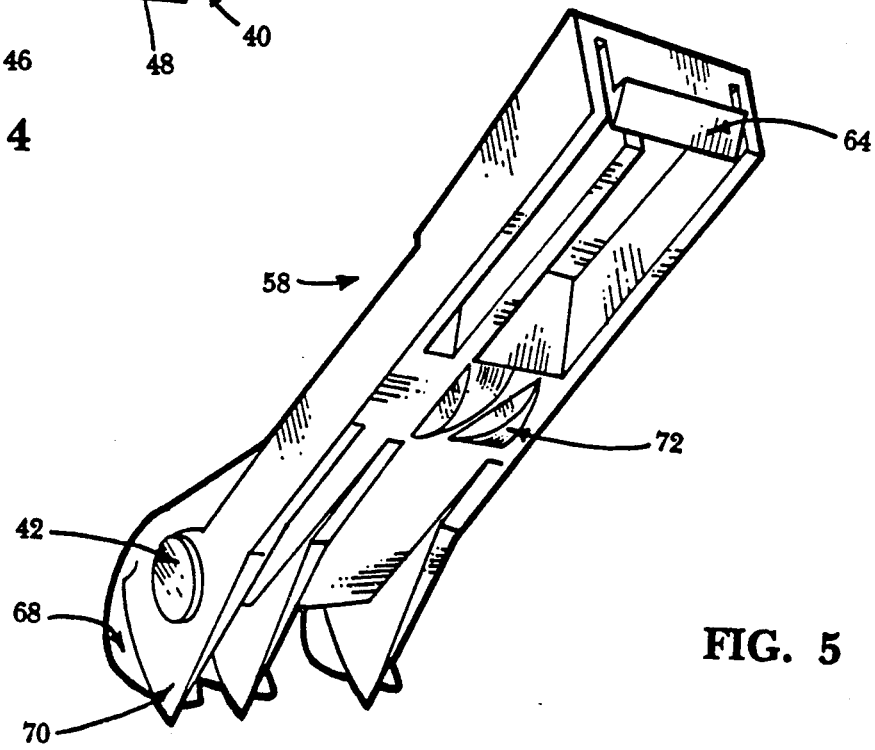
FIG. 5 is a bottom view in perspective of one preferred embodiment of the splicing arm for the electrical connector shown in FIG. 1.
Figure 5A:
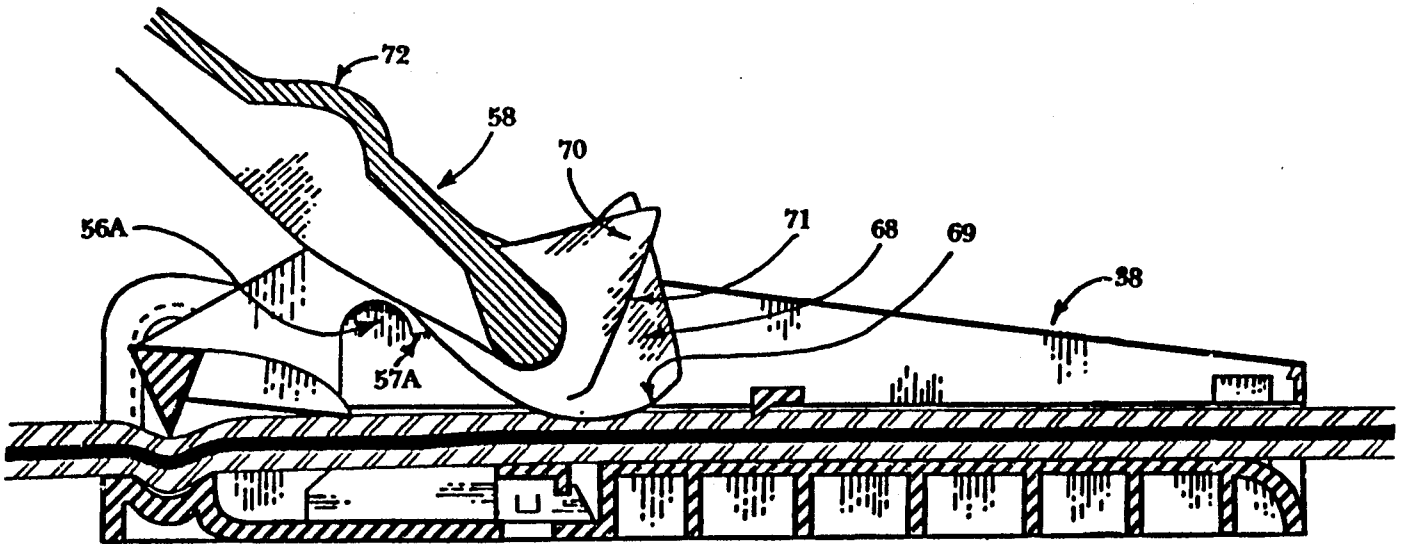
FIGS. 5A, 5B and 5C are side elevation sectional views illustrating the operation of the splicing arm shown in FIG. 5.
Figure 5B:
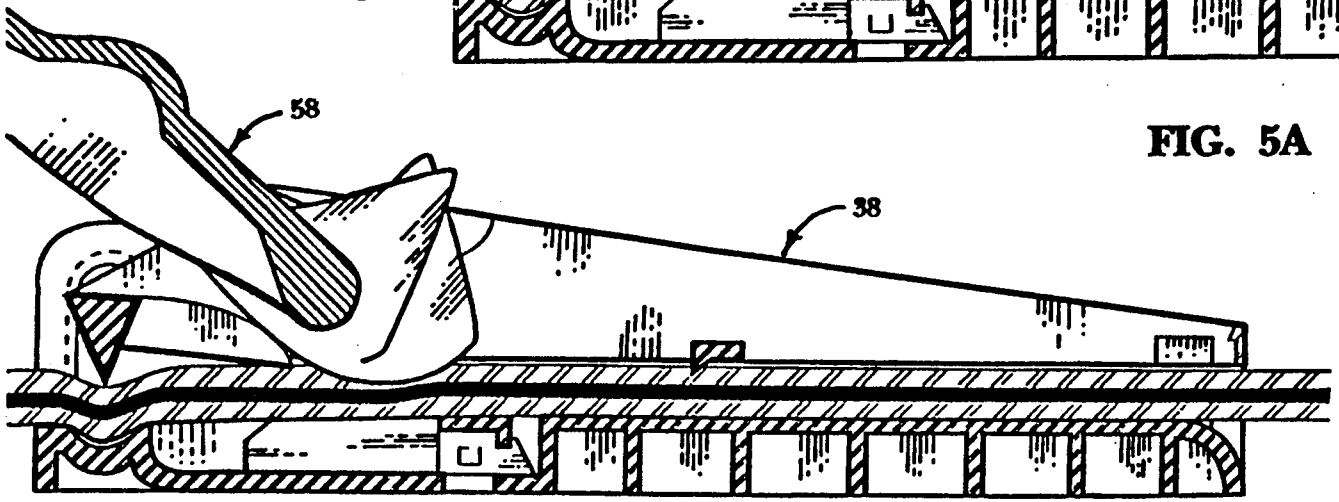
Figure 5C:
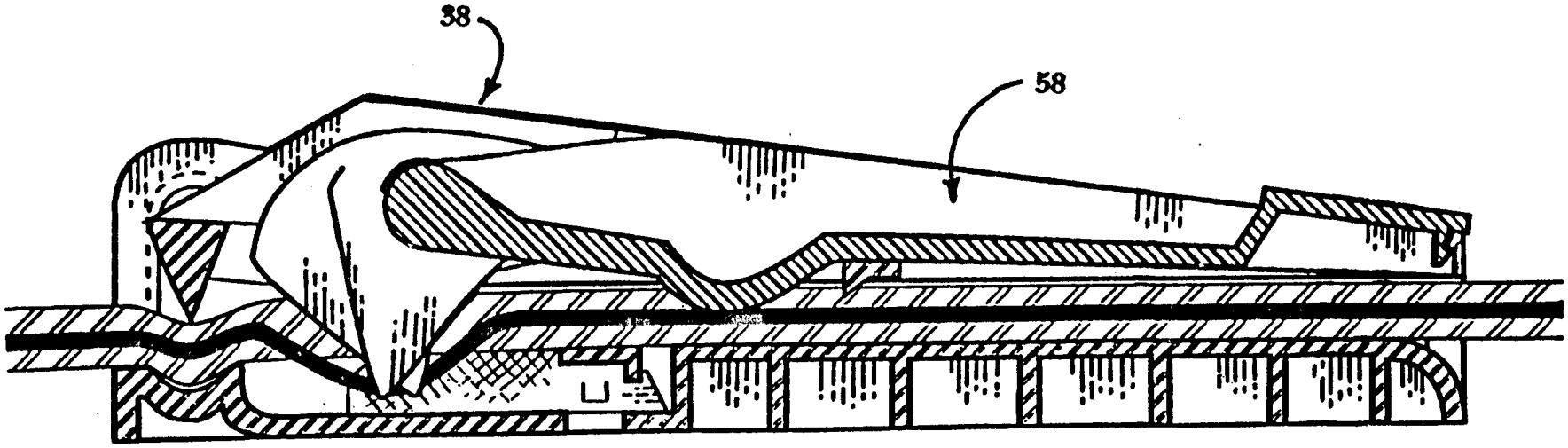

According to the invention, splicing arm 58 will have a pivotal range of rotation about splicing axis 62 (shown in FIG. 1 as a dotted line through the mid-point of axle 61) of up to about 180 degrees. The portions of sidewalls 39A, 39B defining fitting grooves 56A, 56B, respectively, prevent the splicing arm from being pulled out of the clamping arm during pivotal movement thereof. Referring to FIG. 1A, splicing arm 58 is formed with a snap clamp 64 on the back end thereof. Like latching element 55 described above, snap clamp 64 has a generally right-triangular cross-section, but is oriented inversely with respect to element 55. By pressing the back end of splicing arm 58 onto the back end of clamping arm 38, clamp 64 will snappingly engage latching element 55 to maintain the splicing arm 58 in a closed position relative to the clamping arm, and thus restrain the splicing arm from rotational movement. To facilitate splicing of the conductor cable in accordance with the practice of the present invention, splicing arm 58 is provided with a plurality of splicing blades 68 formed integrally therewith (three such blades are shown in FIG. 1 which is most preferred). As here embodied, each blade is formed with a sharpened arcuate contact surface 69, although the blades may be fabricated in any other configuration suitable to achieve the objects of the invention as disclosed hereinafter. According to the invention, the splicing blades will follow a clockwise rotational path (i.e., from left to right as shown in FIGS. 5A–5C) with the arcuate contact surfaces thereof descending into the area bounded by the jagged inner surfaces of the corresponding U-shaped connection plate 24. The action of pivotally drawing splicing arm 58 about axis 62 will cause contact surfaces 69 to cut through the conductor cable and separate the conductor wires from the surrounding insulation. Preferably, each sharpened contact surface 69 should be dimensioned to splice a length of cable from about ¼ inch to about ¾ inch to ensure that a firm, solid spatial and electrical connection with the downstream connector (via connection plates 24) can be effectuated, and minimize the generation of excessive heat and resistance at the connection points.

Because the portions of the conductor cable to be spliced are positioned over the openings to sockets 26, rather than resting upon solid portions of the base structure, there is no bearing surface to provide resistance against downward forces applied to those portions of the cable. Thus, during the splicing process, the pivotal rotation of each splicing blade will tend to draw the cable downwardly into sockets 26 such that the blade may have difficulty cutting all the way through the cable insulation. Advantageously, the sharpened peaks of bevelled edges 26e formed on the sidewalls of each socket 26 act to alleviate this potential problem. As the splicing blades rotate and begin to separate the conductor wires from the insulation, the insulation is pushed against the sharp peaks of bevelled edges 26e, which in turn grip the insulation and thereby prevent the cable from being drawn into sockets 26 until the insulation has been completely severed.

Referring again to FIG. 1, there is shown a plurality of wire pushers 70 formed integrally with splicing blades 68. As here embodied, one pusher flares slightly away from each blade so as to form a gap therebetween. Like the splicing blades, each wire pusher 70 has a sharpened edge 71 which can pierce and separate the insulation surrounding the conductor wires. As here embodied, the sharpened edge 71 of each pusher 70 is oriented rearwardly relative to sharpened edge 69 of the corresponding splicing blade such that during rotation of the splicing arm, each edge 71 will trail corresponding edge 69. Thus, after each splicing blade 68 rotates to cut the conductor cable and separate the conductor wires from the insulation, the corresponding wire pusher 70 will follow so as to further cut the insulation.

As the splicing arm rotates, each conductor wire will be caught and held in the gap formed between the corresponding blade and wire pusher. Further rotation of the splicing arm will cause each splicing blade/wire pusher pair to push the corresponding conductor wire into the corresponding socket 26, thence into the corresponding connection plate 24. As preferably embodied, the width of each blade/pusher pair is generally equal to the distance between the jagged inner surfaces of the corresponding connection plate sidewalls, thereby causing the sidewalls to resiliently yield slightly outwardly as the blade and wire pusher rotate through the connection plate. As the blade/pusher exits the corresponding connection plate, the sidewalls will spring back causing the jagged inner surfaces thereof to frictionally engage the corresponding conductor wire, thereby holding the wire in electrical contact with the connection plate and allowing the blade and pusher to move free of the wire.

Figure 6A:
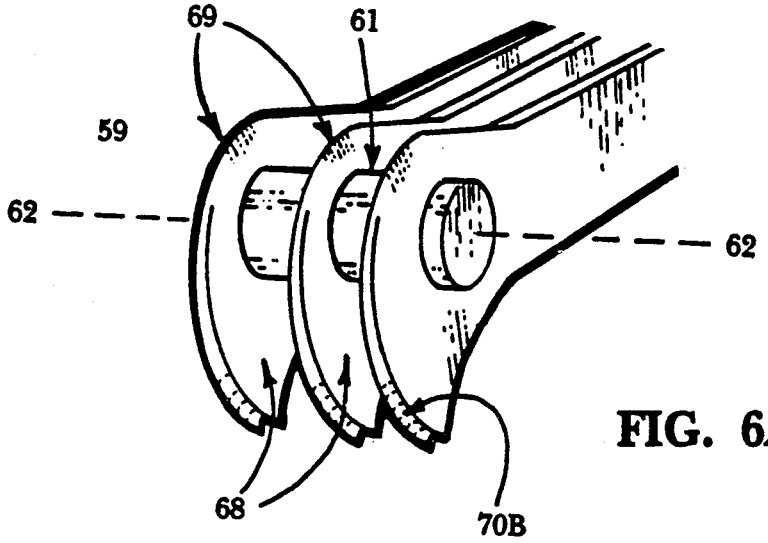
FIGS. 6 and 6A show alternative embodiments of the splicing blade/wire pusher elements of the splicing arm shown in FIG. 5.
Figure 6:
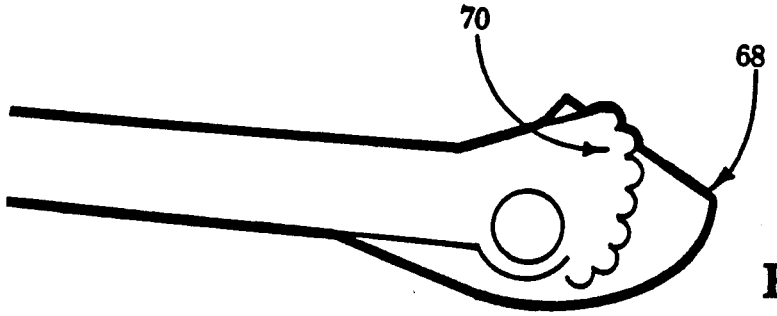

While it is preferred that the each wire pusher 70 have a continuous surface edge 71 as shown in FIG. 1, the edges may also be segmented or "scalloped" as shown in FIG. 6, or of any other design which will facilitate the steps of cutting, engaging, and pushing down the "stripped" conductor wires into electrical contact with the connection plates. As shown in FIG. 6A, splicing arm 58 may also be configured so that each splicing blade/wire pusher pair is configured to form channel 70b therebetween to hold the corresponding conductor wire.

Referring to FIG. 5B, there is shown a preferred embodiment of splicing arm 58 including a pressing element 72 formed transversely thereon, and positioned rearwardly of splicing blades 68. As here embodied, for applications involving the use of a cable including an information-carrying ribbon conductor, pressing element 72 will depress the ribbon cable strip into the grooved depression 29 of pier 28, and thereby into spatial and electrical contact with the piercing and connecting IDC's 30 extending up through the ribbon cable sockets 27. Of course, those skilled in the art will quickly recognize that pressing element 72, along with the grooved depression 29 and ribbon cable receiving sockets 27/IDC's 30, may be omitted from the electrical connector of the invention for applications wherein the cable has a non-conductive strip in lieu an information-carrying ribbon conductor. Those skilled in the art will further recognize that the splicing mechanism of the present invention may be readily adapted to a wide range of splicers for use with electrical connectors already known in the art.

Figure 7:
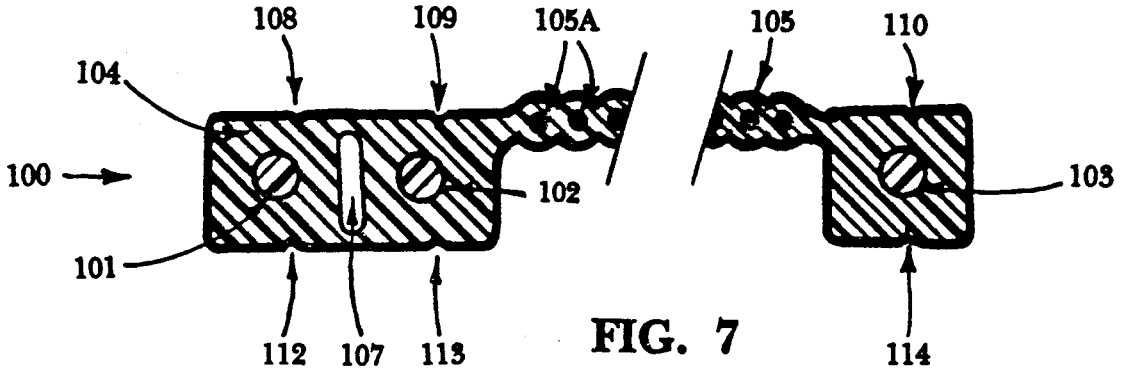
FIG. 7 is a cross-sectional rear view of a preferred embodiment of a conductor cable for use with the electrical connector shown in FIGS. 1–6.

Referring now to FIG. 7, there is shown in crosssection a conductor cable 100 provided as part of the present invention which is particularly well suited for use with the electrical connector 10 described above. As here embodied, the cable 100 has three conductor wires 101, 102, and 103 embedded in insulation 104, with conductor 102 being the "live" or current-carrying conductor wire. Preferably, the insulation surrounding the three conductors should be square or rectangular in configuration. Both the conductor wires and the insulation can be made from materials known in the art. For example, the conductors can be made of copper, silver, or an alloy thereof, while the insulation can be made from any of the synthetic rubber or plastic materials currently used by those skilled in the art.

According to the invention, conductor wires 101 and 102 are asymmetrically separated from conductor wire 103 by a series of smaller conductor wires 105A embedded within a flat or ribbon cable 105. Alternatively, ribbon cable 105 can be replaced with a nonconductive strip of plastic when a ribbon cable connection is not desired. As here embodied, an internal cavity 107 is provided between conductor wires 101 and 102 to allow these wires to be easily detached. This will allow for the additional flexibility of connecting conductor wires 101 and 102 individually to a standard electrical system.

As shown in FIG. 7, cable 100 is provided with contact grooves 108, 109 and 110 formed in insulation 104. According to the invention, contact grooves 108, 109 and 110 are located above conductor wires 101, 102 and 103, respectively, to provide an entry point for splicing blades 68, and are positioned slightly off-center with regard to the corresponding conductor wire's cross-sectional central point. Cable 100 is further provided with relief grooves 112, 113 and 114 on the underside of the insulation 104, preferably positioned in substantial vertical alignment with contact grooves 108, 109 and 110, respectively. As here embodied, relief grooves 112, 113 and 114 provide an exit point for splicing blades 68 as they splice through cable 100.

Figure 8:
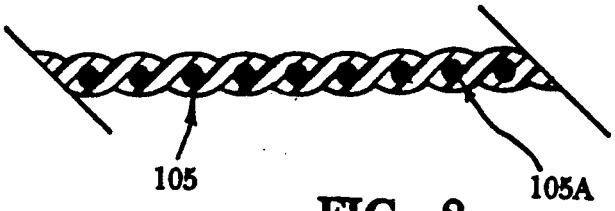
FIG. 8 is a cross-sectional view of a typical "flat" or "ribbon" type conductor cable.

FIG. 8 illustrates a standard ribbon strip-type conductor cable 106 for use with the electrical connector of the present invention. When this type of cable is utilized, splicing arm 58 would not be required to have splicing blades 68 or wire pushers 70. Instead, the splicing arm would simply have a pressing element 72 for pressing the individual ribbon conductor wires 105A into contact with the IDC's 30, which in turn would make contact with the connecting elements of a downstream electrical connector. Also, the base structure 12 could be configured with a substantially flat bottom segment 14, without raised pier 28 and grooved depression 29, for positioning of the cable within the connector. The ribbon cable receiving sockets 27 containing the IDC's 30 would then extend through the bottom segment at the appropriate connection points relative to a plug or other receptacle.

Operation of electrical connector 10 of the present invention conjunction with the preferred embodiment of conductor cable 100 shown in FIG. 7 is relatively straightforward. First, conductor cable 100 is positioned and aligned in passageway 20 of base structure 12 between side walls 16 and 18. Because clamping arm 38 and splicing arm 58 are not yet attached to the base structure, an unexposed conductor cable of any length may be positioned in the passageway 20.

Figure 9:
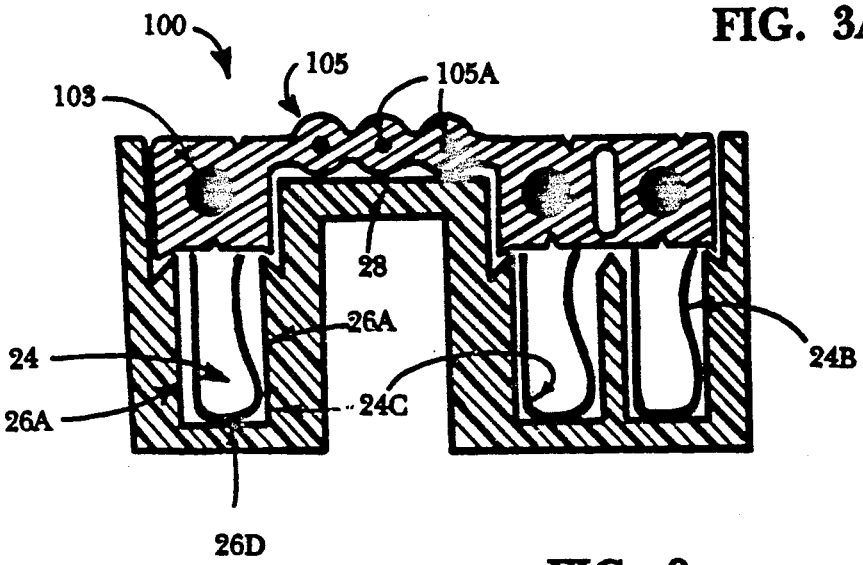
FIG. 9 is a rear elevation view through line A—A of the base structure shown in FIG. 3 illustrating the positioning of the conductor cable shown in FIG. 7 therewithin.
Figure 10:
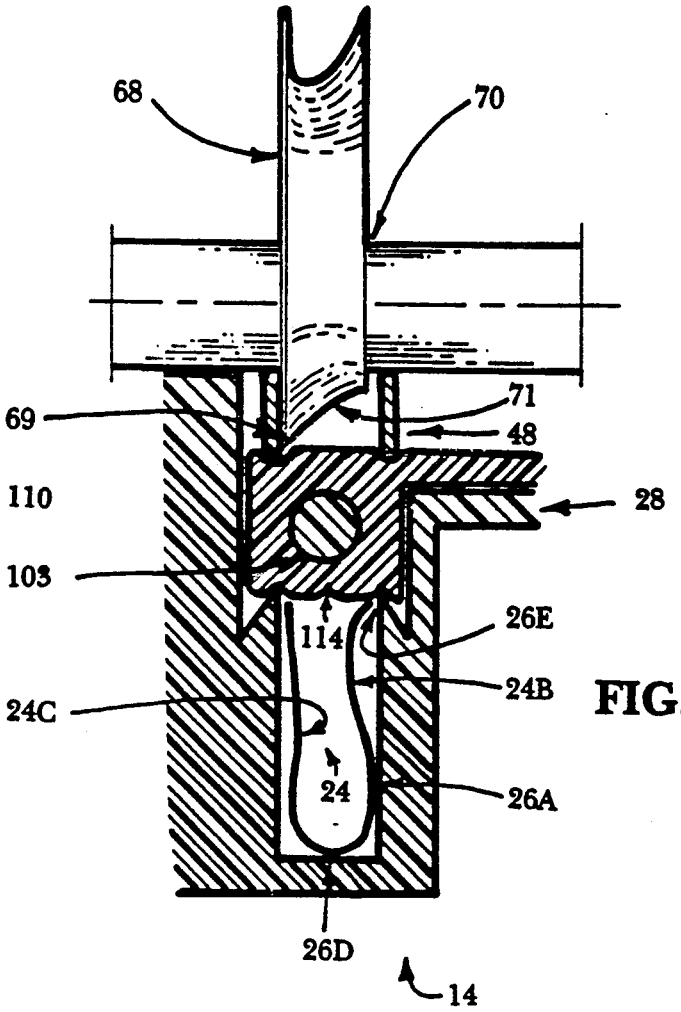
FIG. 10 is a partial rear elevation view illustrating the operation of the splicing blade/wire pusher components of the electrical connector shown in FIG. 1.

The conductor cable will lie within the base structure such that each of conductor wires 101, 102 and 103 is positioned above a corresponding socket 26, and rests upon bevelled edges **26*e* of the socket sidewalls (see FIGS. 9–10). The ribbon strip cable portion of conductor cable 100 will rest upon pier 28 and extend over grooved depression 29 and ribbon cable sockets 27 above IDC's 30 (see FIG. 9). As will be readily apparent to those skilled in the art, the asymmetrical cross-sections of base structure 12 and cable 100** intrinsically reduce the potential for cable misalignment within the fully assembled connector. For example, if the conductor cable were inadvertently rotated 180 degrees along its planar axis, it would not align properly in the base structure, thereby precluding subsequent installation of the clamping and splicing arms.

With the conductor cable properly aligned in passageway 20, clamping arm 38 can next be attached to base structure 12. To this end, clamping arm 38 is first inverted and oriented so that clamping finger 46 faces the back end of base 12. As discussed above, the clamping arm is then advanced forwardly in contact with the conductor cable causing fitting extensions 40 and 42 to slide downwardly along the corresponding mounting ridges 35A, 35B, and pop up into the corresponding fitting grooves 34A, 34B under the resilient force of the cable. At this point, the fitting extensions are held securely within the mounting grooves by the resilient force of the cable against the clamping arm. The clamping arm is next rotated clockwise about its pivot axis 44 (using the orientation of connector 10 illustrated in FIGS. 4A–4C as a frame of reference) via downward pressure applied to lever arm 51 causing clamping finger 46 to press the cable into cable trench 36 and hold it in place.

At the same time, clamping thumbs 48 and clamping element 50 will also press down on the cable to maintain it in a fixed position, with clamping thumbs 48 further pressing the cable down on bevelled edges **26*e* formed on sidewalls 26*a* of each socket 26. As previously mentioned, each clamping element 46 and 48 will clamp the conductor cable as close as possible to the plane of rotation of splicing blades 68 without ever physically contacting the blades. Further clockwise rotation of the clamping arm will cause inverse latching elements 52, 53 to snappingly engage the corresponding latching elements 15A, 15B formed on the sidewalls of base structure 12**. In this position, the clamping arm is prevented from rotational movement about the base structure, thereby preventing subsequent misalignment of the cable.

With clamping arm 38 properly engaged to the base structure, splicing arm 58 can next be mounted to the clamping arm. To this end, splicing arm 58 is first inverted and oriented so that the splicing blades 68 face the back end of clamping arm 38. As discussed above, the splicing arm is then advanced forwardly in contact with the conductor cable causing mounting knobs 59 and 60 to slide downwardly along the corresponding mounting ridges 57A, 57B, and pop up into the corresponding mounting grooves 56A and 56B under the resilient force of the cable. During this process, splicing blades 68 will seat in contact grooves 108, 109 and 110 and make their initial cuts into cable 100. As with the clamping arm, the resilient force of the cable against the splicing arm will maintain knobs 59, 60 securely within mounting grooves 56A, 56B. Thereafter, the splicing arm is rotated clockwise about its splicing axis 62 (using the same connector orientation shown in FIGS. 5A–5C) so that contact surface 69 of each splicing blade 68 begins to cut through insulation 104 of the cable to expose conductor wires 101, 102 and 103 (FIG. 10 shows one of the splicing blades entering contact groove 110).

Further rotation of splicing arm 58 will cause contact surfaces 71 of wire pushers 70 to also sever the cable insulation, and one of conductor wires 101, 102 and 103 to be engaged between each splicing blade/wire pusher pair. Continued rotational movement of the splicing arm will cause the insulation, which is being held against the sharpened peaks of bevelled edges **26*e* via clamping thumbs 48, to tear away from the conductor wires, and each conductor wire to be pushed downwardly by the corresponding blade/pusher pair into the corresponding connection plate 24. As discussed above, rotational movement of the blade/pusher pair through the connection plate will cause the sidewalls thereof to first yield outwardly and then spring back, thereby causing the jagged inner surfaces of the connection plate to frictionally electrically engage the exposed conductor wire, and the blade/pusher pair to move free thereof. As each splicing blade/pusher element is cutting the conductor cable and pushing the corresponding spliced conductor wire into contact with its corresponding connection plate, pressing element 72 formed on splicing arm 58 will push the ribbon cable conductors 105A downwardly into grooved depression 29 and against piercing IDC's 30 projecting from ribbon receiving sockets 27**.

After splicing arm 58 has completed its rotational path about axis 62, thereby establishing a secure electrical connection between the conductor wires and connection plates, the splicing arm is urged further downwardly against the base structure until snap clamp 64 formed thereon snappingly engages latching element 55 formed on the back of clamping arm 38. In this position, the splicing arm is restrained from further rotational movement. The fully assembled electrical connector with spliced conductor cable secured therein can then be electrically connected to the downstream electrical connector. If a live conductor cable has been passed through connector 10, the individual wires can be separated from the insulation downstream of the connector and securely capped with standard wire screw caps.

Figure 11:
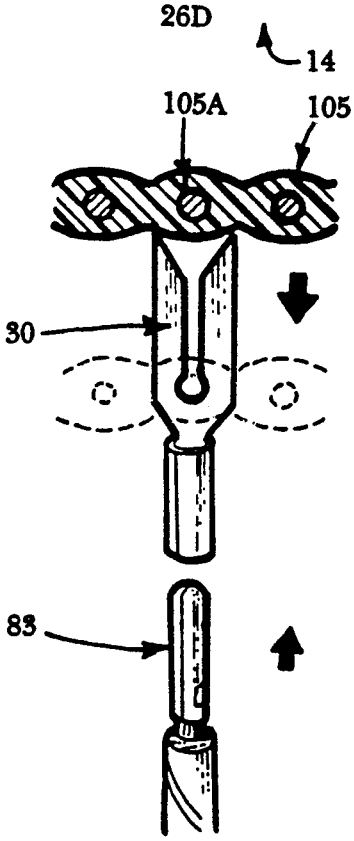
FIG. 11 is a perspective view of a standard information displacement connector mating with a corresponding pin element on a plug.

To connect electrical connector 10 to the downstream connector in accordance with one preferred embodiment of the invention, plug blades 82 of interior plug 80 are slidably inserted through the corresponding openings **26*c* in sockets 26, and slidably frictionally inserted into the corresponding slots 25*a* of connection prong members 25 formed in the corresponding connection plates 24. At the same time, pins 83 enter the corresponding ribbon receiving sockets 27 and are mated with the corresponding IDC's 30 (see FIG. 11), and connection element 84 is slidably frictionally inserted into channel 12*b* formed in base structure 12 to secure interior plug 80 to the base structure. At this point, electrical connection between adaptor 80 and electrical connector 10 is established, and conductor wire 85** can be electrically connected to the downstream electrical connector. Those skilled in the art will also see that the base structure 12 may first be mounted to the plug as via the appropriate connecting elements as heretofore described, and the conductor cable can then be positioned inside the passageway 20. The clamping arm and then the splicing arm can be mounted and the cable subsequently spliced. The splicing of the conductor cable will then effect electrical connection between the appropriate elements as heretofore described. It is also within the scope of the invention that the base structure be formed as an integral unit with a plug or receptacle. The mounting of the clamping and splicing arms, and the splicing action, would be as previously described.

It will be appreciated by those skilled in the art that the present invention in its broader aspects is not limited to the particular embodiments shown and described herein, and that variations may be made which are within the scope of the accompanying claims without departing from the principle of the invention and without sacrificing its chief advantages.

What is claimed is:

1. An electrical connector, comprising:

a base structure having a bottom segment and first and second opposed side walls attached thereto and including a passageway between said side walls for receiving an insulated conductor cable having wires embedded therein, said base structure further comprising electrical connection means;

a clamping arm pivotally attached to said base structure and having first and second ends, said first end terminating in at least one clamping means for clamping a length of conductor cable into pre-slicing alignment in said passageway of said base structure, and said second end for moving said first end into clamping contact with a conductor cable;

a splicing arm pivotally attached to said clamping arm, said splicing arm having first and second ends such that said first end terminates in at least one pivotable cutting means and at least one wire pusher element such that pressure on or about said second end of said splicing arm causes said pivotable cutting means and said wire pusher element to pierce an insulated conductor and splice some of the wire therein away from the insulation whereupon said cutting means and said wire pusher element engages the spliced wire and moves the wire into spatial and electrical connection with said electrical connection means.

2. An electrical connector as claimed in claim 1, wherein said connector is of three piece molded construction.

3. An electrical connector as claimed in claim 1, wherein said connector is made of plastic.

4. An electrical connector as claimed in claim 1, further comprising a second clamping means attached to said clamping arm.

5. An electrical connector as claimed in claim 1, wherein said clamping arm is removably attachable to said base structure and said splicing arm is removably attachable to said clamping arm.

6. An electrical connector as claimed in claim 1, further comprising a plug electrically integrated with a second conductor cable, said plug comprising elements for mating with said electrical connection means of said electrical connector.

7. An electrical connector as claimed in claim 1, wherein said wire pusher element is scalloped.

8. An electrical connector as claimed in claim 1, further comprising a raised cable trench such that a conductor cable is held therein by said clamping means.

9. An electrical connector as claimed in claim 1, wherein said base structure has a ridge portion attached to said bottom segment.

10. An electrical connector as claimed in claim 9, wherein said ridge portion rises to a height not exceeding the height of said side walls.

11. An electrical connector as claimed in claim 1, further comprising an information strip connecting means attached to said splicing arm.

12. An electrical connector as claimed in claim 1, wherein said pivotable cutting means is at least one pivotable blade.

13. An electrical connector as claimed in claim 11, wherein said pivotable cutting means are three pivotable blades.

14. An electrical connector as claimed in claim 1, further comprising a first latching element on said base structure and a second latching element on said clamping arm such that said first and second latching elements are mutually engageable.

15. An electrical connector as claimed in claim 14, further comprising a third latching element on said clamping arm and a fourth latching element on said base structure such that said third and fourth latching elements are mutually engageable.

16. An electrical connector as claimed in claim 1, further comprising a connection plate housing portion in said bottom segment of said base structure and at least one socket in said connection plate housing portion such that said socket contains said electrical connection means.

17. An electrical connector as claimed in claim 16, wherein said electrical connection means is a connection plate and a connection element.

18. An electrical connector as claimed in claim 17, wherein said pivotable cutting means are three pivotable blades and said connection plate housing portion comprises three sockets and three connection plates and connection elements, said splicing arm further comprising three wire pushers.

19. An electrical connector as claimed in claim 18, wherein each of the top portion of each of said sockets has bevelled edges which point substantially inward for gripping the insulation of a conductor wire.

20. An electrical connector as claimed in claim 19, wherein said connection plates are substantially U-shaped and the inside faces thereof are substantially jagged.

21. An electrical connector as claimed in claim 1, wherein said clamping means is at least one downwardly extending finger.

22. An electrical connector as claimed in claim 21, wherein said clamping means is at least one downwardly extending finger and at least one downwardly extending thumb.

23. An electrical connector as claimed in claim 22, further comprising an additional clamping on said clamping arm left aft of said clamping finger and said clamping thumb.

24. An electrical connector as claimed in claim 10, wherein said ridge portion extends substantially the entire length of said passageway between said side walls.

25. An electrical connector as claimed in claim 24, wherein said ridge portion has a valley therealong, said valley containing at least one receiving socket for housing an insulated displacement connector.

26. An electrical connection system, comprising:

an insulated conductor cable comprising first, second and third conductor wires embedded within the insulation surrounding said conductor cable, said first and second conductor wires being asymmetrically separated from said third conductor wire;

a base structure having a bottom segment and first and second opposed side walls attached thereto and including a passageway between said side walls adapted to receive and retain said conductor cable, said base structure further comprising electrical connection means;

a clamping arm pivotally attached to said base structure and having first and second ends, said first end terminating in at least one clamping member for clamping a length of said conductor cable into pre-slicing alignment in said passageway of said base structure, and said second end for moving said first end into clamping contact with said conductor cable; and a splicing arm pivotally attached to said clamping arm, said splicing arm having first and second ends, said first end terminating in first, second and third pivotable cutting members each provided with a corresponding wire pusher element, said splicing arm pivotally movable about said clamping arm in response to pressure applied to said second end of said splicing arm so as to cause each said pivotable cutting member and corresponding wire pusher element to pierce the insulation surrounding said conductor cable and splice a portion of one of said conductor wires away from the insulation, whereupon each said cutting member and corresponding wire pusher element engages the corresponding spliced wire portion and moves it into spatial and electrical connection with said electrical connection means.

27. A splicing mechanism suitable for use with an insulated electrical cable containing at least one conductor wire embedded within the insulation surrounding said cable, said splicing mechanism comprising at least one blade member and at least one wire pusher member positioned relative to said blade member so as to engage said conductor wire therebetween, said wire pusher member operating from the same cable surface as said blade member and pushing said conductor wire free from said cable insulation as said blade member cuts through said insulation.

* * * * *